United States Patent [19]

Wood

[11] 4,109,849

[45] Aug. 29, 1978

[54] ARTICLE CARRIER

[75] Inventor: Prentice J. Wood, Hapeville, Ga.

[73] Assignee: The Mead Corporation, Dayton, Ohio

[21] Appl. No.: 859,336

[22] Filed: Dec. 12, 1977

[51] Int. Cl.[2] ..... B65D 5/46

[52] U.S. Cl. ..... 229/52 B

[58] Field of Search ..... 229/52 B, 37 R

[56] References Cited

U.S. PATENT DOCUMENTS

| | | | |
|---|---|---|---|
| 2,691,471 | 10/1954 | Forrer | 229/52 B X |
| 2,693,310 | 11/1954 | Stopper | 229/52 B |
| 2,955,739 | 10/1960 | Collura | 229/52 B |
| 3,094,268 | 6/1963 | Swanson et al. | 229/52 B |
| 3,164,316 | 1/1965 | Wurster et al. | 229/52 B X |
| 3,181,772 | 5/1965 | Collins et al. | 229/52 B |
| 3,696,990 | 10/1972 | Dewhurst | 229/37 R |
| 3,790,066 | 2/1974 | Malinowski | 229/52 B |

*Primary Examiner*—Davis T. Moorhead

*Attorney, Agent, or Firm*—Walter M. Rodgers; Walter A. Rodgers

[57] ABSTRACT

An article carrier especially adapted for use in connection with a large number of primary packages comprises a bottom wall, a pair of side walls, and a top wall all foldably joined along their adjacent edges, end closure structure disposed at each end of the carrier, and lifting means comprising a pair of face contacting handle panels and a pair of stress relieving panels foldably joined respectively to the handle panels along the lower edges thereof and to the top walls respectively along the upper edges thereof, and the stress relieving panels being adapted to shift from positions in the planes of the handle panels to positions in the planes respectively of the top walls when the lifting means is manipulated.

11 Claims, 7 Drawing Figures

Fig. 4
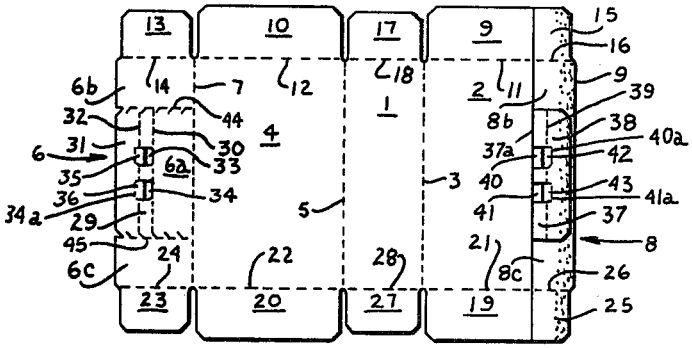
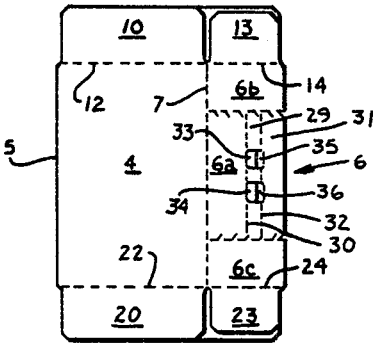
Fig. 5
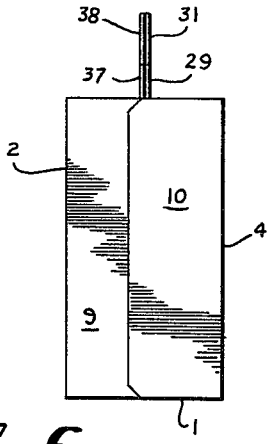
Fig. 6
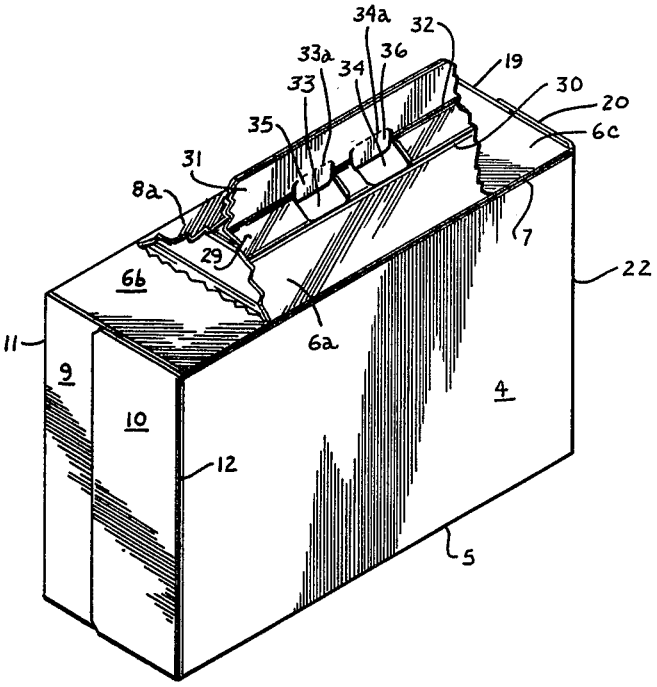
Fig. 7

ARTICLE CARRIER

The current trend is toward the packaging of large primary packages and to include greater numbers of primary packages in a single article carrier. As the packaged weight increases, the necessity for added strength and reliability in the area of the handle becomes critical.

According to this invention, an article carrier is provided and comprises a bottom wall, a pair of side walls foldably joined respectively to the side edges of the bottom wall, end closure structure disposed at each end of the carrier, an outer top wall foldably joined to the upper edge of one side wall, an inner top wall secured to the upper edge of the other side wall, lifting means foldably joined to said top walls medially thereof and comprising a pair of face contacting handle panels and a pair of stress relieving panels foldably joined thereto respectively, and each of the stress relieving panels being adapted to shift from a position in the same plane as the associated handle panel to a position in the same plane as the associated portion of the top wall when the lifting means is manipulated.

For a better understanding of the invention, reference may be had to the following detailed description taken in conjunction with the accompanying drawings in which:

FIGS. 3 and 4 depict intermediate stages through which the blank shown in FIG. 2 is manipulated in order to form a complete and collapsed carrier as shown in FIG. 5;

FIG. 6 is an end view of a completed carrier wih the lifting means partially formed; and in which FIG. 7 is an isometric view of a completed carrier with the lifting means disposed in the carrying position.

Figure 2:
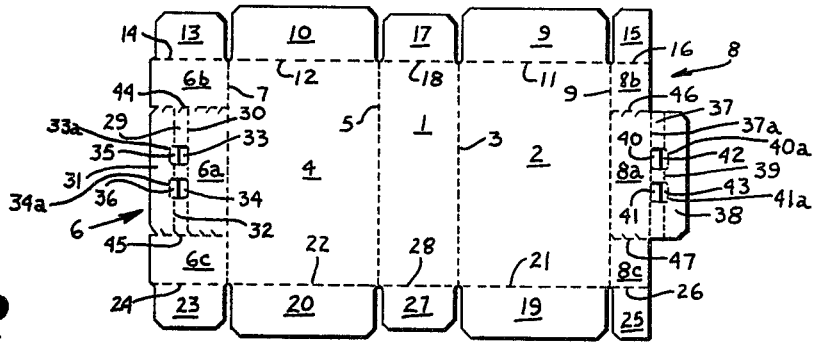
FIG. 2 is a plan view of a blank from which the carrier shown in FIG. 3 is constructed.

In the drawings and with particular reference to FIG. 2, the numeral 1 designates the bottom wall of the carrier to a side edge of which side wall 2 is foldably joined along fold line 3. In like fashion side wall 4 is foldably joined to the opposite side edge of bottom wall 1 along fold line 5.

At one end of the blank, an outer top wall is provided and is generally indicated by the numeral 6. Outer top wall 6 is foldably joined to side wall 4 along fold line 7. In addition outer top wall 6 is provided with inner portion **6*a* together with outer portions 6*b* and 6*c***.

At the other end of the blank, an inner top wall is provided and is generally indicated by the numeral 8. Inner top wall 8 is foldably joined to side wall 2 along fold line 9. In addition inner top wall 8 is provided with inner portion **8*a* together with outer portions 8*b* and 8*c***.

In order fully to enclose the article carrier, end closure means is provided at each end of the carrier. More specifically end panels 9 and 10 are foldably joined to side walls 2 and 4 respectively along fold lines 11 and 12. In addition end panel 13 is foldably joined to outer top wall 6 along fold line 14 and, likewise, end panel 15 is foldably joined to inner top wall 8 along fold line 16. In order to complete the end closure structure at one end of the carrier, end panel 17 is foldably joined to bottom wall 1 along fold line 18.

Similar end closure structure is provided at the other end of the carrier. More specifically end panels 19 and 20 are provided and are foldably joined respectively to side walls 2 and 4 along fold lines 21 and 22. Also end panel 23 is foldably joined to outer top wall 6 along fold line 24 and, similarly, end panel 25 is foldably joined to inner top wall 8 along fold line 26. In addition end panel 27 is foldably joined to bottom wall 1 along fold line 28.

According to one aspect of this invention, lifting means is provided which is especially adapted for use in the transport of a large number of heavy primary packages. More specifically stress relieving panel 29 is foldably joined to inner portion **6*a* of outer top wall 6 along fold line 30. In addition handle panel 31 is foldably joined to stress relieving panel 29 along fold line 32. Also finger holes 33 and 34 are disposed in stress relieving panel 29 and handle panel 31. Finger holes 33 and 34 are provided with hand cushioning flaps 35 and 36** respectively.

The lifting means at the opposite end of the blank is similarly constructed to that just described and includes stress relieving panel 37 which is foldably joined to inner portion **8*a* of inner top wall 8 along fold line 37*a*. In addition handle panel 38 is foldably joined to stress relieving panel 36 along fold line 39. Also finger holes 40 and 41 are disposed in stress relieving panel 36 and handle panel 38 and are provided with hand cushioning flaps 42 and 43** respectively.

As best viewed in FIG. 2, the upper edges of the finger holes 33, 34, 40, and 41 are defined by fold lines **33*a*, 34*a*, 40*a*, and 41*a* respectively. Fold lines 33*a* and 34*a* are offset from fold line 32 and recessed into handle panel 31 and, similarly, fold lines 40*a* and 41*a* are offset from fold line 39 and recessed into handle panel 38. This insures that the vertical lifting force in the completed carrier is assumed by handle panels 31 and 38. In addition this feature aids in eliminating possible tearing of the carrier material around the edges of finger holes 33, 34, 40 and 41** during transport of the carrier.

In order to facilitate manipulation of the carrier lifting means prior to transport of the carrier, tear lines 44 and 45 are provided in outer top wall 6. In similar fashion, tear lines 46 and 47 are provided in inner top wall 8.

Figure 3:
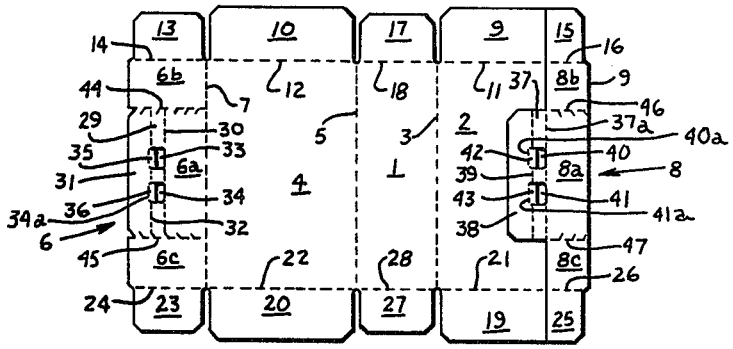

In order to form the completed carrier from the blank shown in FIG. 2, it is simply necessary first to fold inner top wall 8 together with stress relieving panel 37, handle panel 38, and end panels 15 and 25 along fold line 9. The carrier then appears as shown in FIG. 3. Following this operation stress relieving panel 37 and handle panel 38 are folded in a reverse direction along fold line **37*a*** to occupy the positions shown in FIG. 4.

Then an application of glue is made to the blank as shown by stippling in FIG. 4. More specifically glue is applied to inner top wall 8, handle panel 38, and end panels 15 and 25. Then the portions of the blank disposed to the left of fold line 5, as shown in FIG. 4, are elevated and folded over to the right along fold line 5. By this operation handle panels 31 and 38 are adhered together. In addition outer top wall 6 is adhered to inner top wall 8 and, similarly, end panels 13 and 23 are adhered respectively to end panels 15 and 25. The carrier then appears as shown in FIG. 5 which represents the completed carrier in collapsed condition.

In order to erect the carrier from the collapsed condition shown in FIG. 5, it is simply necessary to move side walls 2 and 4 apart to the positions whereby the side walls are perpendicular to the top and bottom walls. Primary packages may then be loaded through one or both ends of the carrier. In order fully to enclose the carrier, end panels 13, 15 and 17 at one end of the carrier and end panels 23, 25 and 27 at the other end of the carrier are folded inwardly. Subsequently end panels 9 and 19 are folded inwardly and an application of glue is made thereon. To complete the end closure structure at each end of the carrier, end panels 10 and 20 are folded along their respective fold line 12 and 22 and adhered to end panels 9 and 19 respectively. The carrier then appears as shown in FIG. 1.

Figure 1:
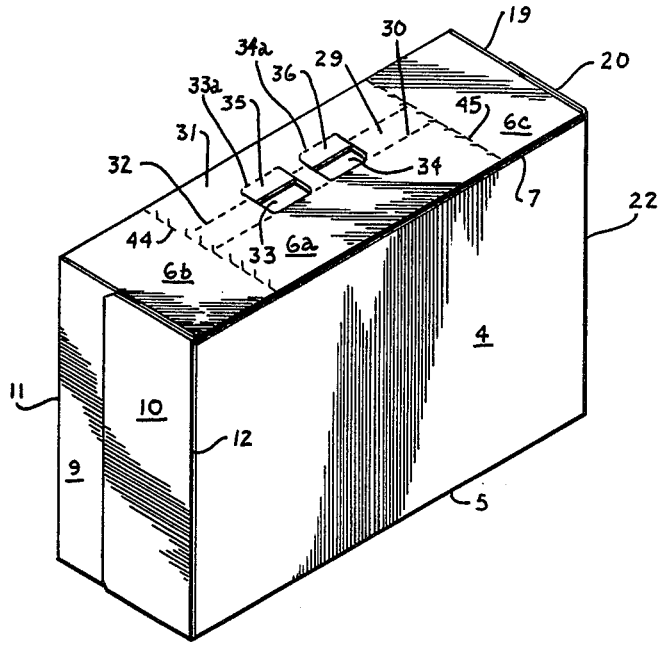
FIG. 1 is an isometric view of a completed article carrier constructed according to this invention.

In order to form the lifting means into the position shown in FIG. 6, it is necessary to elevate the lifting means from the position shown in FIG. 1 by severing the portions of tear lines 44 and 45 which define the end edges of handle panels 31 and of stress relieving panel 29 and swinging the handle and stress relieving panels over along coincidental fold lines 30 and 37*a* to positions perpendicular to the top wall of the carrier. In this position the lifting means is partially formed and the stress relieving panels 29 and 37 are disposed in the planes respectively of the handle panels 31 and 38 as shown in FIG. 6.

In order to transport a fully loaded carrier, it is simply necessary to fully elevate the lifting means by the utilization of the finger holes as is well known. By this operation the remaining portion of tear lines 44 and 45 together with tear lines 46 and 47 are severed and the carrier then appears as shown in FIG. 7. As the lifting means is manipulated in this fashion, stress relieving panels 29 and 37 are shifted to positions in the same planes respectively as inner portions 6*a* and 8*a* of their respective top walls 6 and 8.

Therefore since stress relieving panels 29 and 37 are not glued together, the handle panels 31 and 38 are elevated to a position above the top wall of the carrier when the lifting means is manipulated. This allows a large portion of the weight of the carrier to be assumed by the side walls. In addition the utilization of stress relieving panels 29 and 37 reduces the delamination forces which are inherent in connection with glued handle panels 31 and 38. Specifically the delamination forces are the greatest when the lower edges of handle panels, such as 31 and 38, are coincidental with the medial edges of the top wall portions, such as 6*a* and 8*a*. Therefore by this invention an article carrier is provided which has lifting means adapted for use in connection with primary packages of very heavy weight.

The embodiments of the invention in which an exclusive property or privilege is claimed are defined as follows:

1. In a hexagonal article carrier, lifting means comprises a pair of face contacting handle panels, a pair of stress relieving panels foldably joined respectively to said handle panels, an outer top wall foldably joined to one of said stress relieving panels remote from said handle panel, an inner top wall foldably joined to the other of said stress relieving panels remote from said handle panel, and each of said stress relieving panels being adapted to shift from a position in substantially the same plane as the associated handle panel to a position in substantially the same plane as the associated top wall when said lifting means is manipulated.

2. Lifting means according to claim 1 wherein a finger hole is disposed in said handle panels and said stress relieving panels.

3. Lifting means according to claim 2 wherein the upper edge of said finger hole is recessed into said handle panels.

4. Lifting means according to claim 1 wherein said handle panels are glued together.

5. An article carrier comprising a bottom wall, a pair of side walls foldably joined respectively to the side edges of said bottom wall, end closure structure disposed at each end of the carrier, an outer top wall foldably joined to the upper edge of one of said side walls, an inner top wall secured to the upper edge of the other of said side walls, said inner and outer top walls being disposed in face contacting relation to each other, lifting means foldably joined to said top walls medially thereof and comprising a pair of face contacting handle panels and a pair of stress relieving panels foldably joined thereto respectively, a pair of transverse tear lines disposed in said top walls, and each of said stress relieving panels being adapted to shift from a position in the same plane as the associated handle panel to a position in the same plane as the inner portion of the associated top wall when said lifting means is manipulated.

6. An article carrier according to claim 5 wherein said lifting means is disposed intermediate said tear lines in each of said top walls.

7. An article carrier according to claim 5 wherein a finger hole is disposed in said lifting means.

8. An article carrier according to claim 7 wherein the upper edge of said finger hole is recessed into said handle panels.

9. An article carrier according to claim 5 wherein said handle panels are glued together.

10. An article carrier according to claim 7 wherein the lower edge of said finger hole coincides with the upper edges of said inner portions.

11. An article carrier according to claim 7 wherein a hand cushioning flap is foldably joined to one of said handle panels along the upper edge of said finger hole.

* * * * *